US006811529B1

(12) United States Patent
Plourde et al.

(10) Patent No.: US 6,811,529 B1
(45) Date of Patent: Nov. 2, 2004

(54) PERPENDICULAR PERFORATION ON ZIPPER TAPE FOR AIR EVACUATION OF PACKAGE

(75) Inventors: Eric P. Plourde, Tinley Park, IL (US); John H. Schneider, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/523,338

(22) Filed: Mar. 10, 2000

(51) Int. Cl.[7] ..... B31B 1/14
(52) U.S. Cl. ..... 493/223; 493/227; 493/240
(58) Field of Search ..... 493/223, 227, 493/240, 241, 194, 199; 383/103, 100; 53/133.8

(56) References Cited

U.S. PATENT DOCUMENTS 2,689,678 A * 9/1954 Wendt
4,011,798 A * 3/1977 Bambara et al.
4,284,228 A * 8/1981 Cetrelli
4,338,085 A * 7/1982 Sullivan et al.
5,002,782 A * 3/1991 Oberle
5,020,661 A 6/1991 Marco
5,115,910 A 5/1992 Klygis et al.
6,265,002 B1 * 7/2001 Blatter

* cited by examiner

*Primary Examiner*—Eugene L Kim
(74) *Attorney, Agent, or Firm*—Pitney Hardin LLP

(57) ABSTRACT

The plastic bags are provided with a web tape with a row of aperatures which are cut parallel to each other, but perpendicular to the direction of travel of the row. The aperatures are not colinear with one another. The apertures are sized to allow air to pass therethrough but not to allow selected solids to pass therethrough. These apertures are cut with a rotating wheel with teeth parallel to the axis of rotation and sized to provide the apertures of the desired size.

6 Claims, 2 Drawing Sheets

PERPENDICULAR PERFORATION ON ZIPPER TAPE FOR AIR EVACUATION OF PACKAGE

BACKGROUND OF THE INVENTION

1. Field of the Invention

This invention relates to the use of perpendicular perforations on a zipper tape for the evacuation of air entrapped in a package, such as a plastic bag.

2. Description of the Prior Art

In the prior art, it is known to provide perforations to provide for a predetermined teat line across sheet media. In order to increase the chances that the resulting tear remains on the tear line, the tear line can comprise colinear line segments oriented in the direction of the perforation. However, if the perforations are desired for some purpose other than providing a tear line, for example to provide for evacuation of air from within a package, the is use of a tear line comprised of colinear line segments oriented in the direction of the perforation is disadvantageous in that this increases the chances of tear propagation along the tear line.

Prior art slit perforating uses a round wheel with raised teeth around its periphery to cut slits which are colinear line segments (see FIG. 1). The teeth are pressed against a hardened anvil roller and a web, or sheet, of material is pulled between the perforating wheel and the anvil roller. Where the tooth comes into contact with the anvil roll a slit (cut) is left in the web. Between the teeth the web is left intact (tie). The lengths of these cuts and ties along with the material being perforated determines the tendency of the web to tear along the perforation. A low ratio of tie area to cut area is illustrated in FIG. 1 and results in a maximized likelihood of tearing. However, in order to minimize the likelihood of tearing, it is necessary to have a high ratio of tie area to cut area. In other words, in order to reduce tear tendency with traditional slit perforating, a relatively large tie area is needed, but this large tie area would result in a low number of slits per lineal inch.

Air evacuation slits are typically very small, such as 0.008 inches, to keep the contents of the bag (such as flour) from being forced out through the slits when the package is compressed to evacuate the air. A large number of slits are required to evacuate air through the very small slits quickly enough so that it does not slow down the automatic packaging equipment.

Moreover, air evacuation apertures for containers made from sheets of plastic web, such as plastic bags, are frequently formed by lasers, which can be expensive.

Prior art references disclosing tear-open elements for carrier stock include U.S. Pat. No. 5,115,910 entitled "Carrier Stock With Tear-Open Band Segments" issued to Klygis et al. on May 26, 1992 and U.S. Pat. No. 5,020,661 entitled "Carrier Stock With Tear-Open Tabs" issued to Marco et al. on Jun. 4, 1991.

OBJECTS AND SUMMARY OF THE INVENTION

It is therefore an object of this invention to provide an apparatus and method for quickly evacuating air from a package.

It is therefore a further object of this invention to provide an apparatus and method to provide a perforation which is tear resistant.

It is therefore a still further object of this invention to provide an apparatus and method to provide a perforation with a high ratio of tie area to cut area.

It is therefore a still further object of this invention to provide an apparatus and method which achieves the above objects at a low price.

These and other objects are attained by providing zipper tape with a perforation comprised of a series of tears which are parallel line segments which are perpendicular (or at least something other than parallel or colinear) to the direction of the perforation. A cutting wheel is used to generate this perforation.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 2:
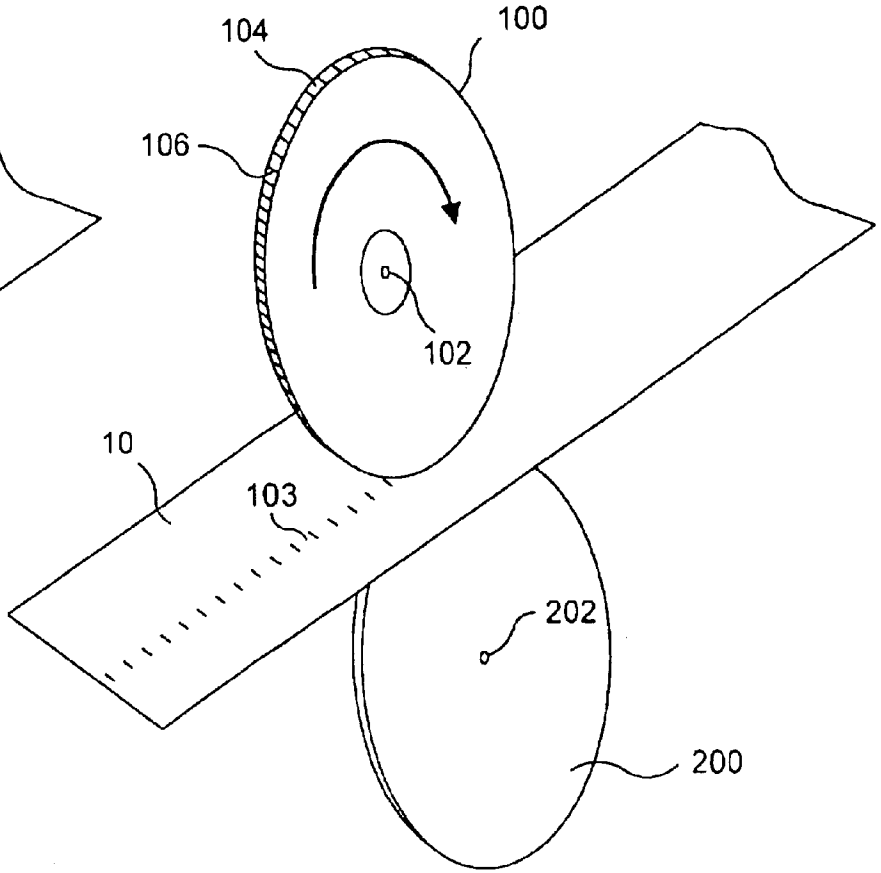
FIG. 2 is a perspective view of the cutting wheel of the present invention providing a perforation of the present invention.
Figure 1:
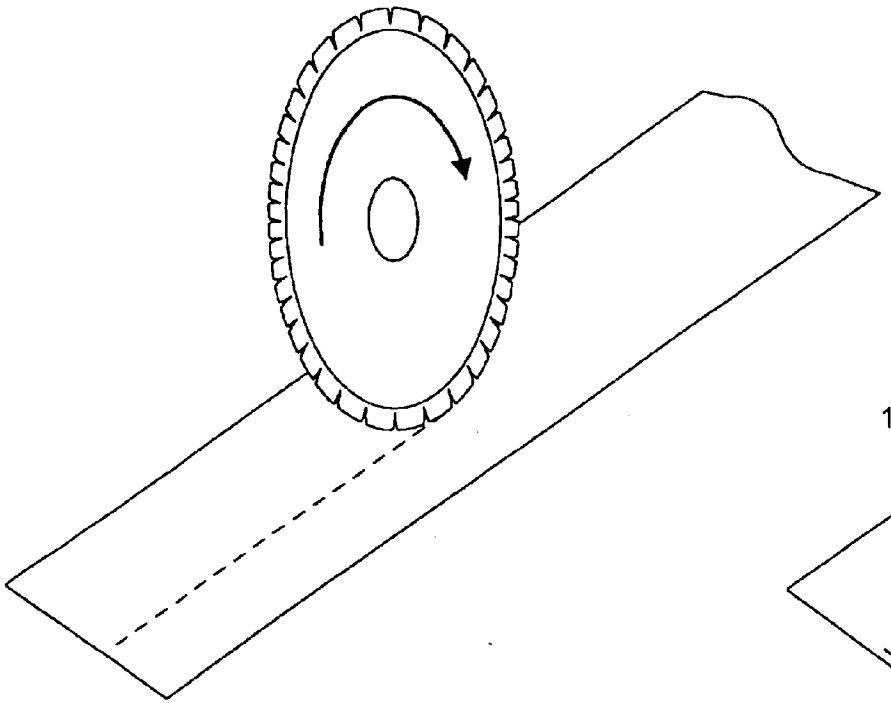
FIG. 1 PRIOR ART
FIG. 1 is a perspective view of a cutting wheel of the prior art providing a perforation of the prior art.

Referring now to the drawings in detail wherein like numerals indicate like elements throughout the several views, one sees that FIG. 2 is a perspective view of cutting wheel 100 which rotates about axis 102. The peripheral surface 104 of cutting wheel 100 includes spaced parallel blades 106 which are parallel with axis 102. The spacing between successive blades 106 is chosen to be equal to the desired tie length, while the length of each blade 106 is chosen to be equal to the desired cut length.

Cutting wheel 100 bears against anvil roller 200 which rotates about axis 202. Zipper tape 10 (or other sheet media) is drawn through the nip formed between opposing anvil roller 200 and rotating cutting wheel 100 thereby cutting perforations 103 in the image of the peripheral surface 104 including spaced parallel blades 106. Perforations 103 are parallel to each other, perpendicular to the direction of the row of perforations, and as stated above, have a tie distance equal to the spacing between cutting blades 106 and a cut distance equal to the length of cutting blades 106.

Alternatively, cutting blades can be oriented in directions which, while not colinear with each other, are something other than parallel, such as alternating oblique lines (e.g., /\/\/\/\/\/\/) or even pseudo-random orientations.

Figure 3:
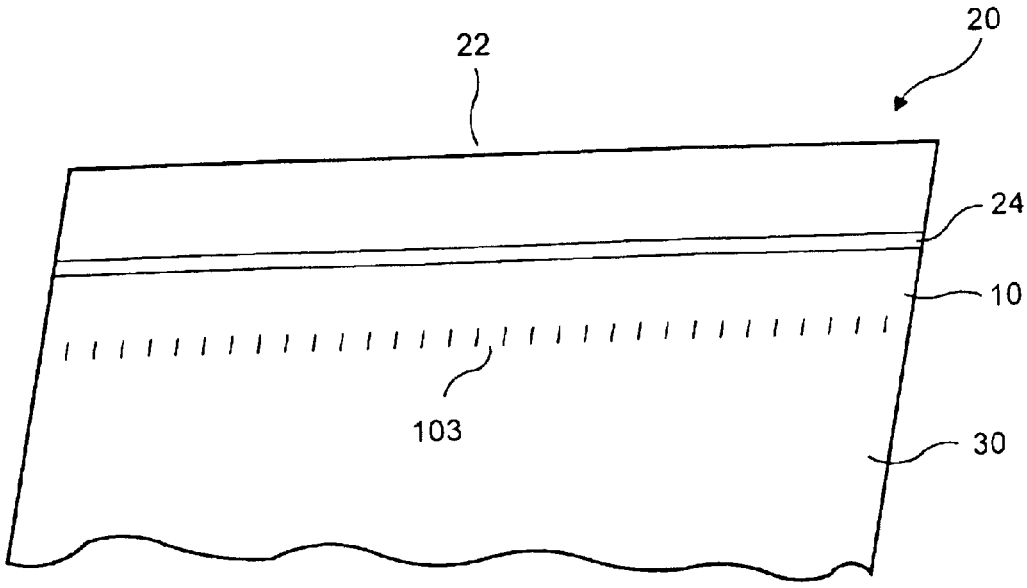
FIG. 3 is a plan view of a typical plastic bag incorporating the perforation of the present invention.

A resulting typical plastic bag 20 is shown in FIG. 3, including mouth 22 sealed by zipper profile 24 formed on zipper tape 10. Zipper tape 10 is secured to the walls 30 of the plastic bag 20. Perforations 103 may be formed inwardly adjacently from zipper profile 24 and are sized to allow air within plastic bag 20 to escape while not allowing the contents of the plastic bag 20 (such as flour) to escape through perforations 103. A typical length of the individual perforations is 0.008 inches. The parallel non-colinear orientation of the perforations with respect to each other results in a configuration where a tear is unlikely to propagate along the line of perforations 103.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A method for providing a line of through vent apertures to a web component of a plastic bag, said web component having a tendency to tear along lines of apertures, comprising the steps of:

providing a cutter which cuts a line of vent apertures along a first direction, said vent apertures being oriented in a second direction which is not parallel to said first direction such that the orientation of said vent apertures with respect to said line minimizes tear propagation of said web component along said line;

providing an anvil means against which said cutter bears, thereby creating a nip; and drawing the web component through said nip formed between said cutter and said anvil means thereby forming said line of vent apertures in the web component;

wherein said vent apertures provide ventilation to the interior of said plastic bag when said web component is attached to said plastic bag.

2. The method of claim 1 wherein said cutter is a cutting wheel which rotates about an axis, a periphery of said cutting wheel including teeth which are not perpendicular to said axis.

3. The method of claim 2 wherein said teeth are parallel to said axis.

4. The method of claim 3 wherein said teeth are sized as spaced so as to form aperatures which allow air to pass therethrough, but which do not allow selected solids to pass therethrough.

5. The method of claim 4 wherein said anvil means is a rotating wheel.

6. The method of claim 5 wherein said web component is a zipper tape.

* * * * *